US006234478B1

(12) United States Patent
Smith

(10) Patent No.: US 6,234,478 B1
(45) Date of Patent: May 22, 2001

(54) GAME DIAL SETTABLE TO ALTER PLAYER'S ODDS OF SUCCESS

(76) Inventor: Jason Nathaniel Smith, 1814 Susquehanna St., Harrisburg, PA (US) 17102

( * ) Notice: Subject to any disclaimer, the term of this patent is extended or adjusted under 35 U.S.C. 154(b) by 0 days.

(21) Appl. No.: 09/280,532

(22) Filed: Mar. 30, 1999

(51) Int. Cl.[7] ..... A63F 5/04

(52) U.S. Cl. ..... 273/141 R; 273/142 R; 273/142 HA

(58) Field of Search ..... 273/141 R, 141 A, 273/141 K, 142 HA, 142 H, 142 R

(56) References Cited

U.S. PATENT DOCUMENTS

| | | | | |
|---|---|---|---|---|
| 136,048 | * | 2/1873 | Elliot | 273/141 R |
| 3,135,515 | | 6/1964 | Kinsey | 273/141 R |
| 3,224,112 | * | 12/1965 | Hanson | 273/141 R |

* cited by examiner

*Primary Examiner*—Benjamin H. Layno

(57) ABSTRACT

A game dial device includes a plurality of disks and a spinner rotatably mounted about a common axis. A base member contains a circumferential row of numbers representing bonuses generated from the game and a portion marked with a distinguishing notation or symbol. An upper disk member superimposed on the base member contains a number of fields representing varying degrees of success, an indicator window, and a portion marked with a distinguishing notation or symbol. A spinner is rotatably mounted on the dial operable to sweep the fields upon actuation by the player.

6 Claims, 2 Drawing Sheets

GAME DIAL SETTABLE TO ALTER PLAYER'S ODDS OF SUCCESS

BACKGROUND—FIELD OF INVENTION

This invention relates to a game dial designed to alter a player's odds of success based on varying game conditions.

BACKGROUND —DESCRIPTION OF PRIOR ART

In some conventional game dials, a plurality of segments are located arbitrarily in fixed positions on the face of the dial, each segment bearing a notation such as a number or instructions to be carried out by the players and an indicator or spinner, mounted for sweeping movement with respect to the segments, is adapted to be actuated by one of the players and register with one of the segments when it comes to rest and thereby advance the game or decide the outcome thereof. A dial of this type does not have a means for selective adjustment of the segments and consequently players are unable to alter their odds of success based on varying game conditions.

OBJECTS AND ADVANTAGES

The disadvantages and limitations of the previous game dials are obviated by the present invention. The present invention provides an effective and simple device that may be precisely adjusted to alter a player's odds of success based upon bonuses generated by the game. It is, therefore, a primary object of the present invention to provide a game dial incorporating means whereby the dial may be set adjusted based on a player's bonuses generated from the game to alter the player's odds of success.

The dial of the present invention comprises an upper disk member containing a number of fields representing varying degrees of success, a base member containing a circumferential row of numbers representing bonuses generated from the game, and a spinner rotatably mounted on the dial operable to sweep the fields upon actuation by the player. Based upon the player's bonus generated from the game, differing fields become activated and the odds of success may be customized to the particular player.

DRAWING FIGURES

The various features and details of the construction and use of the dial are more fully set forth hereinafter with reference to the accompanying drawings, in which.

SUMMARY

Figure 1:
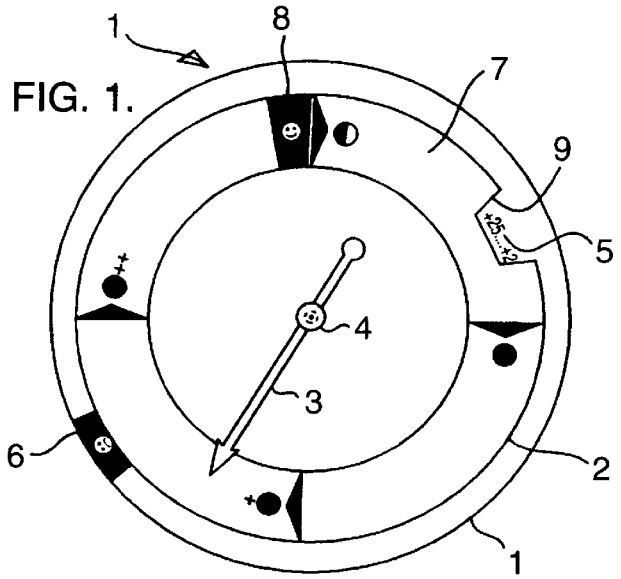
FIG. 1 is a top plan view of a dial for games made in accordance with the present invention.

In accordance with the present invention, the dial consists of a base member 1 of generally circular form, an upper disk member rotatably supported concentrically of the base 2 and a spinner 3 mounted on a spindle 4 for rotation centrally of the base 1 and the upper disk 2.

In accordance with the second embodiment of the present invention, the dial consists of a base member 10 of generally circular form, an upper disk member rotatably supported concentrically of the base 20 and a spinner 30 mounted on a spindle 40 for rotation centrally of the base 10 and the upper disk 20.

DESCRIPTION

Figure 2:
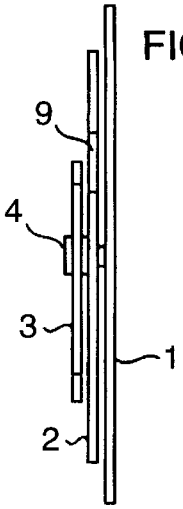
FIG. 2 is a side elevational view of the dial.
Figure 3:
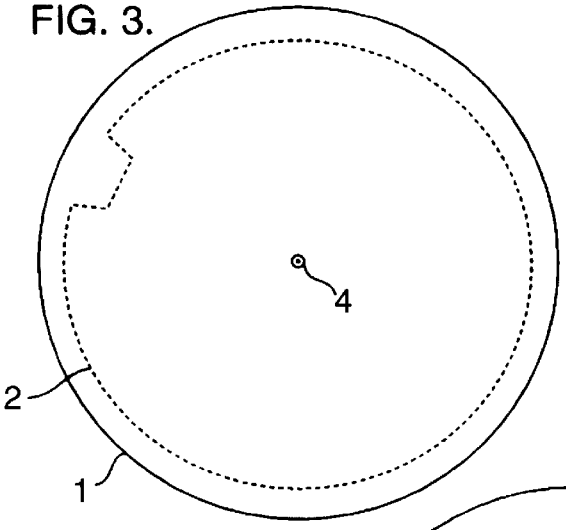
FIG. 3 is a bottom plan view thereof.
Figure 4:
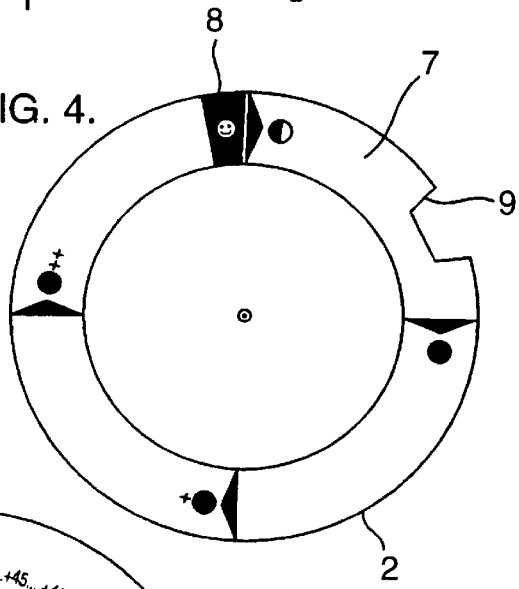
FIG. 4 is a top plan view of the top disk member of the dial removed therefrom.
Figure 5:
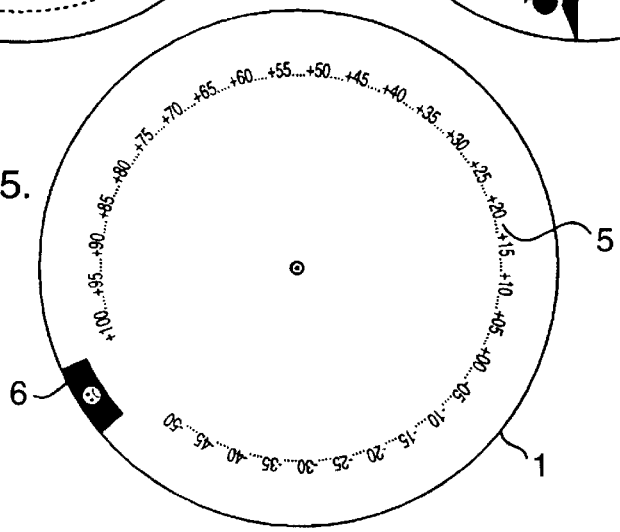
FIG. 5 is a top plan view of the base member of the dial assembly.

Referring now to the drawing, FIGS. 1–5 are of an embodiment device 1. The base member 1 has a circumferential row of numbers 5 representing the bonus of a player generated from the game and a portion 6 marked with a distinguishing notation or symbol, for example, a frowning face. It is noted that the circumferential row of numbers 5 are greatest at the portion 6 and decrease in a clockwise direction around the dial. The upper disk member 2 has an annular portion 7 which defines a plurality of fields representing varying degrees of success, a portion 8 marked with a distinguishing notation or symbol, for example, a smiling face, and an indicator window 9. It is noted that the varying degrees of success represented by the plurality of fields in the annular portion 7 increase in a clockwise direction starting from the portion 8 and that each degree of success is marked with a distinguishing notation or symbol, for example, a half circle, full circle, circle with plus sign, or circle with double plus sign.

The upper disk member 2 overlies the base member 1 so that bonuses represented on the circumferential row of numbers 5 may be exposed in the indicator window 9. A spinner 3 is rotatably mounted on the dial operable to sweep the fields upon actuation by the player.

Figure 6:
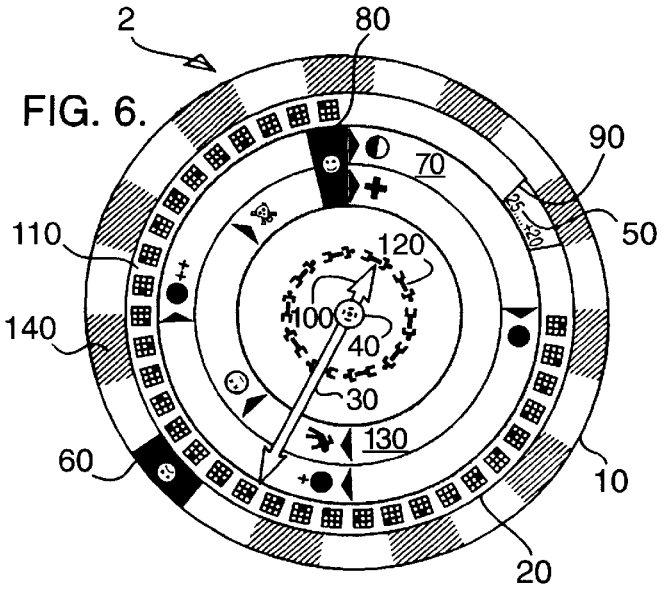
FIG. 6 is a top plan view of a second embodiment dial for games made in accordance with the present invention.
Figure 7:
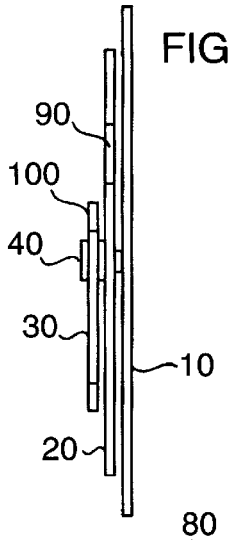
FIG. 7 is a side elevational view of the second embodiment dial.
Figure 8:
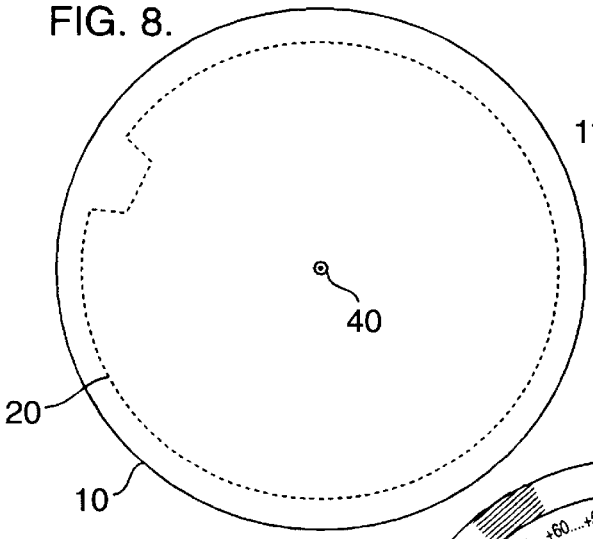
FIG. 8 is a bottom plan view thereof.
Figure 9:
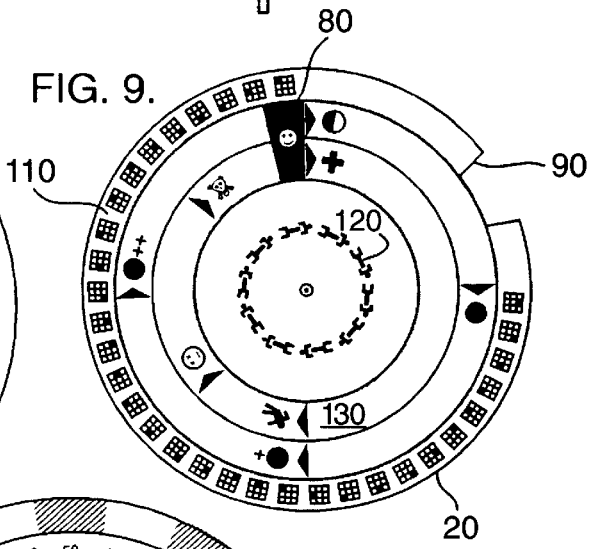
FIG. 9 is a top plan view of the top disk member of the second embodiment dial removed therefrom.
Figure 10:
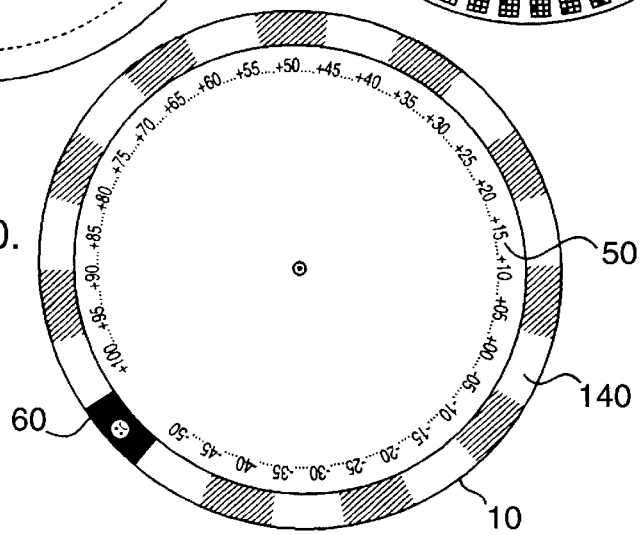
FIG. 10 is a top plan view of the base member of the second embodiment dial assembly.

FIGS. 6–10 are of an embodiment device 2. The base member 10 has a circumferential row of numbers 50 representing the bonus of a player generated from the game, an annular portion 140 which defines a plurality of fields, and a portion 60 marked with a distinguishing notation or symbol, for example, a frowning face. It is noted that the circumferential row of numbers 50 are greatest at the portion 60 and decrease in a clockwise direction around the dial. The upper disk member 20 has a portion 80 marked with a distinguishing notation or symbol, for example, a smiling face, an indicator window 90, an annular portion 70, an annular portion 130, an annular portion 110, and an annular portion 120.

The annular portion 70 defines a plurality of fields representing varying degrees of success. It is noted that the varying degrees of success represented by the plurality of fields in the annular portion 70 increase in a clockwise direction starting from the portion 80 and that each degree of success is marked with a distinguishing notation or symbol, for example, a half circle, full circle, circle with plus sign, or circle with double plus sign. The annular portion 130 defines a plurality of fields representing varrying degrees of damage. It is noted that the varying degrees of damage represented by the plurality of fields in the annular portion 130 increase in a clockwise direction starting from the portion 80 and that each degree of damage is marked with a distinguishing notation or symbol, for example, a bandage, fallen man, sleeping face, or crossbones. The annular portion 110 defines a plurality of fields representing miss location.

It is noted that each miss location represented by the plurality of fields in the annular portion 110 is marked with a distinguishing notation or symbol, for example, a 3×3 square grid wherein one of said squares is shaded to indicate a particular direction such as up, upper-right, right, lower-right, down, lower-left, left, or upper-left. The annular portion 120 defines a plurality of fields representing hit location. It is noted that the varying hit locations represented by the plurality of fields in the annular portion 120 are marked with a series of distinguishing notations or symbols, for example, head, arms, torso, or legs.

The upper disk member 20 overlies the base member 10 so that bonuses represented on the circumferential row of numbers 50 may be exposed in the indicator window 90. A spinner 30 is rotatably mounted on the dial operable to sweep the fields upon actuation by the player. An indicator member 100 is mounted in a position to the spinner.

EXAMPLES

Example 1

The dial of the first embodiment may be used, for example, to determine a player's success or failure in a war game between opponents which is characterized by a series of battles and where battle pieces are placed in opposition at one or more battle locations. The number of battle pieces and the strength value for each battle piece may be determined in any suitable manner, for example, by rolling dice. When each of the battles is drawn, there will therefore be a number of pieces on each side which total a given strength value for each opponent. By way of illustration assume that at one battle location one opponent, designated as the attacker, has a strength of 16 and the other opponent, designated as the defender, has a strength of 6, the difference in strength therefore being 10 in favor of the attacker. Similarly, the remaining battle locations would have opposed battle pieces with differences in strength. The winner of each battle and the war may be determined by the use of the dial and it is noted that the opponent having the greater strength at a given battle location would be favored to win that battle and it is on this basis that the dial may be used to resolve the outcome.

Accordingly in the example cited, the upper disk member 2 is rotated such that the number 10 is exposed in the indicator window 9, the spinner 3 is actuated, and the degree of success is determined by the field with which the spinner 3 registers when it comes to rest. If the spinner 3 registers with the portion 8 or with any field in the annular portion 7 located in the segment between the portion 6 and, clockwise, the portion 8, the attacker loses the battle. If the spinner 3 registers with the portion 6, the attacker wins the battle. If the spinner 3 registers with a field in the annular portion 7 located in the segment between the portion 8 and, clockwise, the portion 6, varying degrees of victory are possible. The particular degree of victory is determined by referencing the distinguishing symbol or notation on the appropriate field in the annular portion 7.

Example 2

The dial of the second embodiment may be used, for example, to determine a player's success or failure in a role-playing game which is characterized by a group of players where each player controls an imaginary persona. Each persona is described by various abilities, such as jumping, running, and hiding and each ability corresponds to a numerical value or bonus. When a player's persona attempts an action that relates to a particular ability, the appropriate bonus is used to determine the odds of success for the persona's action attempt. By way of illustration, assume that a player wishes his persona to jump across a deep pit. The persona's bonus for jumping is deemed appropriate and is used to affect the configuration of the game dial, thereby altering the persona's odds of success. The spinner is actuated and the results are interpreted using the rules set forth below. If the action attempt is considered successful, the persona jumps safely across the pit, whereas if the action attempt is considered unsuccessful, the persona fails to jump across the pit and instead falls into it.

Accordingly in the example cited, the upper disk member 20 is rotated such that the bonus for the appropriate ability is exposed in the indicator window 90, the spinner 30 is actuated, and the degree of success is determined by the field with which the spinner 30 registers when it comes to rest. If the spinner 30 registers with the portion 80 or with any field in the annular portion 70 located in the segment between the portion 60 and, clockwise, the portion 80, the action is considered a "failure". If the spinner 30 registers with the portion 60, the action is considered a "success". If the spinner 30 registers with a field in the annular portion 70 located in the segment between the portion 80 and, clockwise, the portion 60, varying degrees of success are possible. The particular degree of success is determined by referencing the distinguishing symbol or notation on the appropriate field.

In addition to determining success for actions in a role-playing game, the dial of the second embodiment may be used to determine success for combat in a role-playing game. By way of illustration, assume that a player wishes his persona to attack a dragon with his sword. The persona's bonus for combat is used to affect the configuration of the game dial, thereby altering the persona's odds of success. The spinner is actuated and then the spinner location is adjusted based upon the attacker's weapon type and the dragon's defensive bonus, as set forth below. If the attack is considered successful, varrying degrees of damage are inflicted on the dragon, whereas if the attack is considered unsuccessful, the sword misses the dragon or the sword hits the dragon but inflicts no damage.

Accordingly in the example cited, the upper disk member 20 is rotated such that the bonus for the appropriate ability is exposed in the indicator window 90, the spinner 30 is actuated, and the degree of damage is determined by the field with which the spinner 30 registers when it comes to rest. If the spinner 30 registers with the portion 80 or with any field in the annular portion 70 located in the segment between the portion 60 and, clockwise, the portion 80, the attack is considered a "miss". The particular location of the miss is determined by referencing the distinguishing symbol or notation in the annular portion 110. If the spinner 30 registers with the portion 60, the attack is considered a "hit". If the spinner 30 registers with a field in the annular portion 70 located in the segment between the portion 80 and, clockwise, the portion 60, varying degrees of damage are possible. The location of the damage is determined by referencing the distinguishing symbol or notation in the annular portion 120 with which the indicator 100 registers. The defensive bonus for this hit location is subtracted from the attack bonus for the weapon. This number is then used to adjust the location of the spinner 30. If the number is positive, the spinner 30 is rotated clockwise by an equivalent number of fields in the annular portion 140. If the number is negative, the spinner 30 is rotated counterclockwise by an equivalent number of fields in the annular portion 140. The location of the spinner 30 after said adjustment determines the degree of damage inflicted on the foe. If the spinner 30 registers with the portion 80 or with any field in the annular portion 70 located in the segment between the portion 60 and, clockwise, the portion 80, the attack has been absorbed by the foe's armor and no damage occurs. If the spinner 30 registers with a field in the annular portion 130 located in segment between the area 80 and, clockwise, the area 6, varrying degrees of damage are possible. The particular degree of damage is determined by referencing the distinguishing symbol or notation on the appropriate field in the annular portion 130.

SUMMARY, RAMIFICATIONS AND SCOPE

Thus the reader will see that the game dial of the invention provides an effective and simple device that may be precisely adjusted to alter a player's odds of success based upon bonuses generated by the game.

While the above description contains many specificities, these should not be construed as limitations on the scope of the invention, but rather as an exemplification of one preferred embodiment thereof. Many other variations are possible. For example, the base member of the dial can have other shapes, such as oval, square, trapezoidal, triangular, etc.; the base member can be comprised of the back cover of a rulebook; additional degrees of success and damage may be noted on the upper disk; difficulty levels may be noted on the upper disk; a plurality of segments for additional game uses may be added to the upper disk or base member, etc.

Thus the scope of the invention should be determined by the appended claims and their legal equivalents, rather than by the examples given.

I claim:

1. A dial for use by players to determine the outcome of a game comprising:

(a) a base member, (b) a circumferential row of characters on the face of the base, said characters representing a plurality of values listed sequentially from a highest value to a lowest value in a circular fashion, (c) a first unique indicia radiating inwardly from the peripheral edge of the base, (d) an upper disk member rotatably supported concentrically of the base, the upper disk having a size that enables said first unique indicia to be visible, (e) a second unique indicia radiating inwardly from the peripheral edge of the upper disk, where the second unique indicia is represented in a similar fashion to the first unique indicia on the base member, wherein the relative position between the first unique indicia and the second indicia being visible, (f) an indicator device situated on the upper disk to visibly view and select one of said characters, (g) a spinner rotatably mounted on the dial operable upon actuation to sweep the face of the dial, (h) a field of success where such field is defined as the area swept by the spinner as the spinner is rotated from the second unique indicia on the upper disk to the first unique indicia on the base member, (i) a field of failure where such field is the remaining area not defined as the field of success, (j) a relationship wherein as the upper disk is rotated, the relative position between the second unique indicia and the first unique indicia changes, changing the size of the area of said field of success, and changing the characters viewed on the indicator device.

2. A dial according to claim 1 wherein the indicator device is comprised of a window.

3. The window according to claim 2 wherein said window is located on the peripheral edge of the upper disk, to visibly display said characters therethrough.

4. A dial according to claim 1 wherein the values are represented by numbers.

5. A dial according to claim 1 wherein the values are represented by words.

6. A dial according to claim 1 wherein the values are represented by symbols.

* * * * *